United States Patent [19]

Ciarcia et al.

[11] Patent Number: 4,932,520

[45] Date of Patent: Jun. 12, 1990

[54] WAITER'S ORDER ORGANIZER WALLET

[76] Inventors: Michael J. Ciarcia, 31 Bayberry Rd., Danvers, Mass. 01923; John V. Hilliard, 163 Standish Rd., North Quincy, Mass. 02171

[21] Appl. No.: 422,788

[22] Filed: Oct. 17, 1989

[51] Int. Cl.[5] ..... B42F 13/00; B65D 27/08

[52] U.S. Cl. ..... 206/232; 283/40; 281/30; 281/31; 229/72; 206/425

[58] Field of Search ..... 206/232, 425; 229/72; 281/29, 30, 31, 38, 44; 283/60.2, 37, 40; 150/147

[56] References Cited

U.S. PATENT DOCUMENTS

| | | | |
|---|---|---|---|
| 632,957 | 9/1899 | Billow | 281/30 |
| 1,554,949 | 9/1925 | Boos | 281/30 |
| 1,567,643 | 12/1925 | Hearne | 281/44 X |
| 2,828,975 | 4/1958 | Wright . | |
| 3,206,225 | 9/1965 | Oleson | 281/35 X |
| 3,847,195 | 11/1978 | Tyrseck | 150/39 |
| 3,870,223 | 3/1975 | Wyant | 229/72 |
| 4,004,690 | 1/1977 | Giarritta | 206/425 |
| 4,314,635 | 2/1982 | Fraser et al. | 206/232 |
| 4,420,112 | 12/1983 | Cline | 281/31 X |
| 4,516,871 | 5/1985 | Leitman | 283/40 X |
| 4,781,379 | 11/1988 | Parks | 273/148 R |
| 4,802,575 | 2/1989 | Martin | 206/232 |

FOREIGN PATENT DOCUMENTS

| | | | |
|---|---|---|---|
| 501035 | 2/1951 | Belgium | 283/37 |
| 375105 | 5/1907 | France | 281/30 |
| 835316 | 12/1938 | France | 281/31 |
| 1279118 | 11/1961 | France | 281/31 |
| 20285 | of 1906 | United Kingdom | 281/30 |

*Primary Examiner*—William Price

*Attorney, Agent, or Firm*—Donald N. Halgren

[57] ABSTRACT

A waiters'/waitresses' wallet for holding order checks while a customer's order is taken, the wallet comprising a left and right hand cover, the left hand cover having a multi page pad thereon, and a plurality of clear plastic envelopes secured to the right hand cover, the envelopes having diagonal corner pockets for holding the checks while the order is taken, the envelopes holding the miniature menus or the checks after the order is taken. The multi page pad having perforated tabs which are removable and attachable to respective envelopes to identify particular tables/customers.

12 Claims, 3 Drawing Sheets

WAITER'S ORDER ORGANIZER WALLET

BACKGROUND OF THE INVENTION (1) Field of the Invention

This invention relates to wallet type organizers and more particularly to a wallet for organizing a restaurant waiter's order taking and billing matters.

(2) Prior Art

Organizers and wallet-like dividers for waiters and waitresses of the prior art fail to permit convenience of table designation in combination with clear bill carrying pockets and tablet menu designation. U.S. Pat. No. 3,847,195 to Tyrseck shows a wallet with three pages hinged along a common hinge line. It is a cardboard device not really suited to long term use and see through pages.

U.S. Pat. No. 3,870,223 to Wyant shows a two pocket portfolio made from a unitary blank which might be inexpensive, but not the type to suit long term hard use of a series of different billings, which can also be used as a writer's backing pad.

U.S. Pat. No. 2,828,975 shows a pocket secretary with tablet holding means, but without organizing capabilities desirable for restaurant utilization.

U.S. Pat. No. 4,004,690 to Giarritta discloses a coupon holder having a plurality of transparent pockets. This would be difficult for a waiter to carry menu items and table designations with this holder.

U.S. Pat. No. 4,781,379 to Parks shows a ticket holder, but does not allow the necessary ease of access a restaurant facility needs.

U.S. Pat. No. 4,314,635 to Fraser el al discloses a three panel portfolio which is useful for checkbooks but not for easily carryable restaurant wallets/portfolios of waiters and waitresses.

BRIEF SUMMARY OF THE INVENTION

The present invention relates to wallets, and more particularly to waiters'/waitresses' "order" organizer. The wallet comprises an outer hard left and right hand rectangularly shaped cover, being hingedly joined along a common side. The inside face of the left hand side has an elongated slot spaced from and parallel to the topmost edge. The right hand side inside face has an elongated slot spaced from and parallel to its hinged side. Each side may be comprised of a resilient cleanable material of envelope configuration which encloses a stiffening member such as a plastic or cardboard sheet.

A multi-page pad of paper with a cardboard backing may be disposed on the inside lefthand cover, with its backing member inserted into the elongated slot disposed in a parallel spaced manner across the top of the left hand cover. Each page in the multi-page pad is connected to the pad by a perforated edge along the top edge of the page. A plurality of rectangles or tabs are disposed across the bottom of each page in the multi-page pad. The rectangular tabs are outlined for removal from their respective pages, by further perforations which facilitate the removal of those rectangular tabs.

A plurality of multi-page clear plastic order ticket sized envelopes, attached to one another along a common longitudinally extending edge, has a backing securement flap, which is disposed into the inside face of the right hand cover. The backing securement flap is disposed through the elongated slot parallel to and spaced from the hinged side thereof.

Each clear plastic envelope has an open top edge for the receipt preferably of a miniature menu, a wine list to aid their memory, or for an order sheet or the like, typically utilized by waiters and waitresses when they write down a customer's order. Each clear plastic envelope also has a diagonally extending corner pocket disposed across one of the lower corners thereof, to hold the order ticket as the order is taken.

Each clear plastic envelope has a further small envelope-like clear plastic enclosure for temporary receipt of one of the rectangles or tabs which have been removed, for reasons explained below, from the multi-page pad disposed upon the inside face of the left hand cover of the wallet. Each small envelope-like clear plastic enclosure has an open top edge for simple insertion and removal of those rectangular tabs. Successive small envelope "tab" enclosures are spaced successively apart along the other elongated side edge of the clear plastic envelopes (on the side opposite their common hinge). This spaced apart disposition permits easy identification of any tab (and any clear plastic envelope to which it is attached and which it identifies).

The inside face of the right hand cover also has a diagonal cover extending diametrically across a mid-portion thereof. The diagonal cover provides further storage and holding capabilities for the wallet.

When a waiter/waitress is assigned a particular table for a particular portion of the day, he/she identifies that particular table by letter or number on the rectangular tabs. He/she then inserts those tabs into the small clear enclosures on each clear plastic "order ticket" size envelope to identify his/her tables. When the waiter/waitress is assigned different tables, he/she removes the old perforated rectangular tab from its small clear enclosure, and inserts a new one which has been removed from the multi-page pad on the opposite left hand cover.

The "order ticket" sized clear plastic envelopes are utilized to support new (unwritten-on) order tickets for their respective tables in the diagonally extending corner pockets, as the orders are being taken. The diagonal slot disposed across the inside face of the right hand cover may be utilized to store completed (and paid-for) order-tickets which the waiter/waitresses have accumulated during their duty period.

The multi-page pad of paper may also contain menu items or "specials" for the day, each page to be torn off for successive days of the week and or for access to new rectangular tabs when new table assignments occur.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENT

Figure 1:
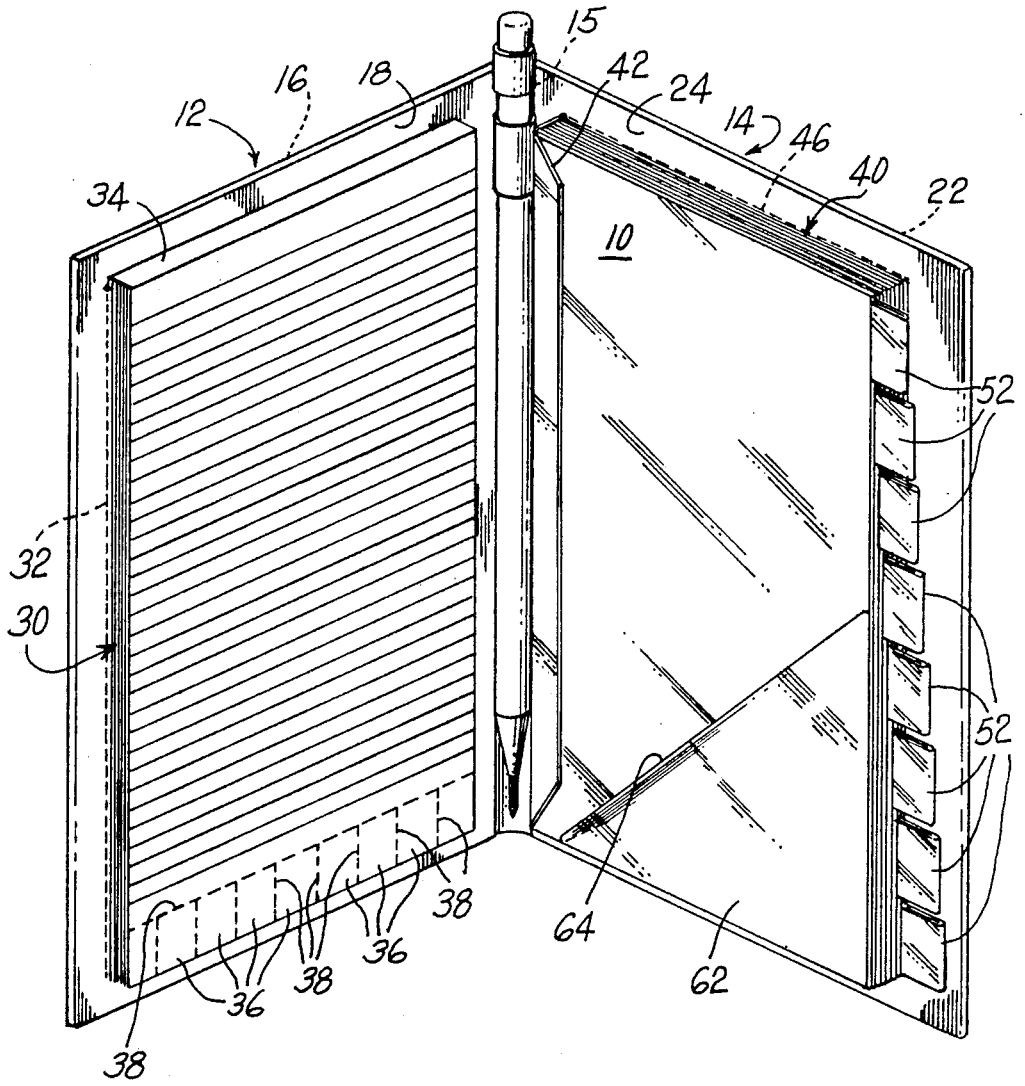
FIG. 1 is a perspective view of an order organizer constructed according to the principles of the present invention.
Figure 2:
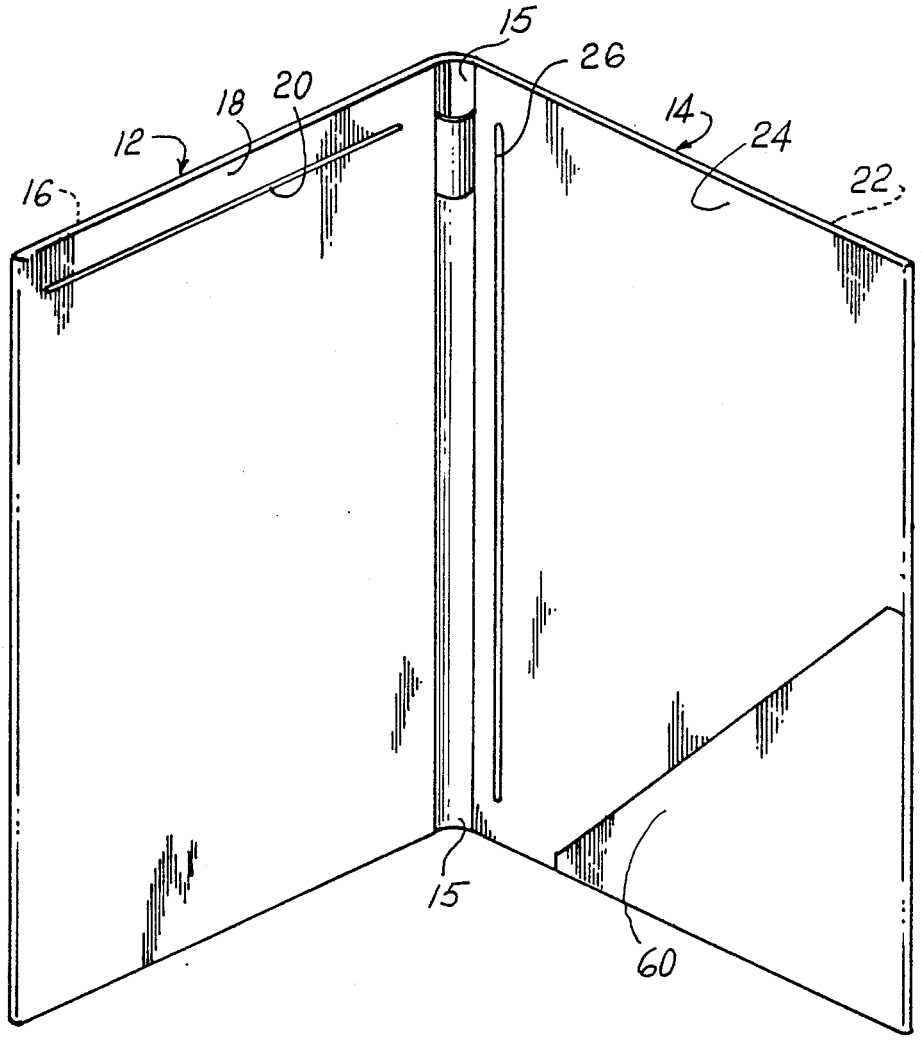
FIG. 2 is a perspective view of the left and right hand cover assembly of the organizer.

Referring now to the drawings in detail, and particularly to FIG. 1, there is shown a waiters'/waitresses' "order" organizer wallet 10. The wallet 10 comprises an outer, hard, left hand cover 12 hingedly joined along a common edge 15, to an outer, hard, right hand cover 14, as best shown in FIG. 2. The left hand cover 12 has an outer face 16 and an inside face)18. The inside face 18 of the left hand cover 12 has an elongated first slot 20 evenly spaced from and parallel to the topmost edge thereof. The elongated slot 20 presents entry to the planar space between the outer face 16 and the inside face 18 of the left hand cover 12. The right hand cover 14 has an outer face 22 and an inside face 24. The inside face 24 of the right hand cover 14 has a longitudinally directed second slot 26 evenly spaced from and parallel to the common edge 15.

A multi-page pad of paper 30 has a cardboard backing 32, attached along an upper edge 34 of the pad 30. The backing 32 is inserted into the first slot 20 and mates with the planar space between the outer face 16 and the inside face 18 of the left hand cover 12. Each page in the multi-page pad of paper 30 is attached to the upper edge 34, by a perforated line, not shown. A plurality of rectangular tabs 36 are disposed along the lowermost edge of each page in the multi page pad 30. Each rectangular tab 36 is outlined for removal from their respective pages, by further lines of perforations 38 which permits the removal thereof.

Figure 3:
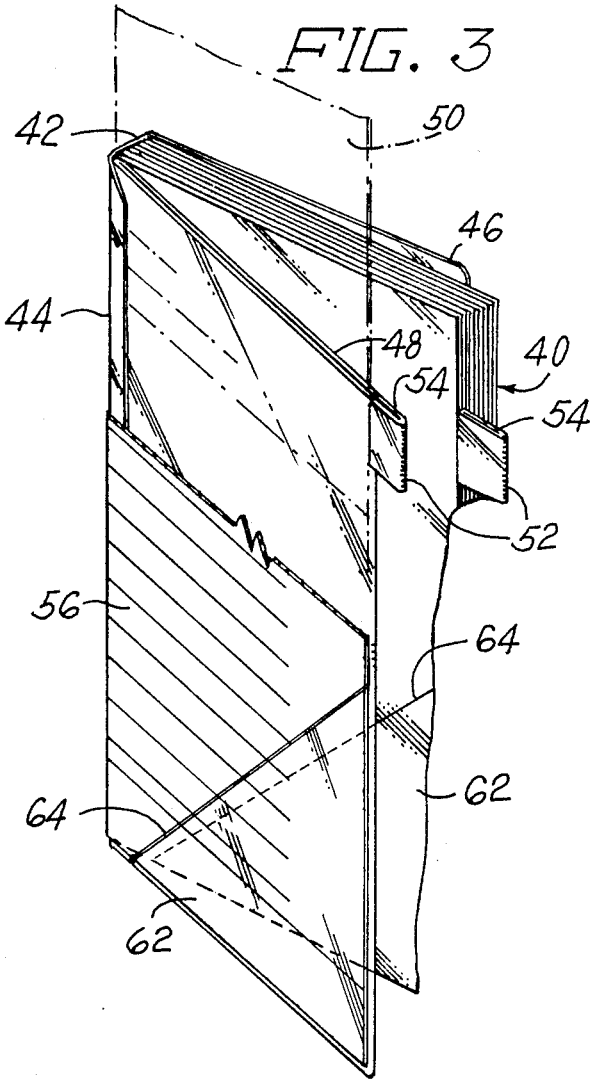
FIG. 3 is a partial perspective view of a divider/carrier insert which mates with the cover assembly shown in FIG. 2.

A plurality of multi-sheath clear plastic "order ticket" sized envelopes 40, are attached to one another to a binder 42 secured along a common longitudinally extending edge 44, to which a backing securement flap 46 is attached, as shown in FIG. 3. The envelopes 40 may be disposed upon the inside face 24 of the right hand cover 14, by insertion of the securement flap 46 into the second slot 26 parallel to the common edge 15 therein.

Figure 4:
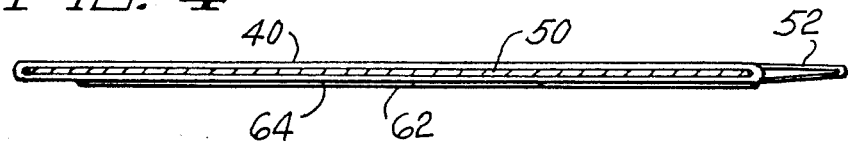
FIG. 4 is a cross-sectional view of one of the leaves of the insert shown in FIG. 3.

Each clear plastic envelope 40 has an open top edge 48 to permit a backing sheet 50, shown in phantom in FIG. 3, and in cross-section in FIG. 4, to be slipped therein. Each backing sheet 50, may have a list of wines or a miniature menu printed on each side thereof. Each envelope 40 also has a further small envelope-like clear plastic enclosure 52 for temporary receipt of the tabs 36. Each enclosure 52 has an open upper edge 54 to permit the insertion, and removal, of those tabs 36. Successive enclosures 52 are spaced successively apart along the other elongated edge of the clear plastic envelopes 40 (on the side opposite the hinge 15).

The inside face 24 of the right hand cover 14 has a diagonal corner cover 60, as shown in FIG. 2, for receipt of "paid-up" order tickets, after they have been removed from their respective envelopes 40, and the customers have paid their page of those order tickets, (which are typically two pages, one being a carbon copy of the other).

Each envelope 40 has a diagonally disposed lower corner pocket 62, as shown in FIGS. 1 and 3. Each pocket 62 has a diagonal edge 64 which extends from half-way up one side of the envelope 40 to adjacent the lower opposite corner. Each corner pocket 62 is utilized to hold an order sheet 56, as shown partially in FIG. 3, when the waiter/waitress is taking the customers' order. Once the order has been taken, and until the order (bill) is given to the customer, the order (bill) is preferably kept inside the corner pocket 62 of each envelope 40, or it may be kept inside the envelope 40, itself.

Each table of customers is designated by an identification number written on a tab 36 and placed in a respective enclosure 52. Upon shift change or reassignment of tables, the "old" tabs 36 are removed from their enclosure 52, and "new" tabs 36 removed from the pad 30 on the left hand cover 12.

Thus there has been shown a unique wallet 10 for organizing and maintaining in clean, separate, easily recognizable, easily reachable compartments, a set of order checks for a waiter/waitress in a busy restaurant. The combination includes replacable menu means in the form of a multi-page pad, each page of which also includes tab means to identify particular table assignments. These clear support means for holding checks while customers orders are taken, may also comprise envelope means for carrying cleanly, the miniature menus or wine lists or even the checks which list the customers requests. Further carrying means in the inside of the rear cover hold the waiters'/waitresses' finished customer's order checks until the end of his/her shift.

We claim:

1. A waiters'/waitresses' order organizer wallet for holding and enclosing customers order checks, comprising:
   - a left hand cover and a right hand cover, each joined along a common edge;
   - a multi page pad removably disposed onto said left hand cover;
   - a plurality of envelopes removably disposed onto said right hand cover;
   - a plurality of removable identification means on each page of said multi-page pad;
   - an enclosure attached to each envelope for receiving said identification means;
   - said enclosures permitting changeable replacement of identification means, said multi page pad providing an accessible source of said identification means to permit the waiter/waitress a simple, efficient means for identifying and neatly maintaining his/her order checks.

2. An organizer wallet as recited in claim 1, including a check securement holder on each envelope to hold the order checks as the customers' orders are being taken.

3. An organizer wallet as recited in claim 2, wherein each envelope is made of clear plastic to permit the waiter/waitress to easily see any items contained therewithin.

4. An organizer wallet as recited in claim 3, including a diagonally disposed corner pocket disposed on said right hand cover, to hold finished paid-up customers' order checks during the balance of the waiters'/waitresses' shift.

5. An organizer wallet as recited in claim 3, wherein said left hand cover has an inside face having a slot along an upper edge thereof, said slot comprising receiving means for receiving a backing sheet on said multi page pad to maintain it disposedly thereon.

6. An organizer wallet as recited in claim 3, wherein said right hand cover has an inside face having a slot along a side edge thereof, said slot comprising receiving means for receiving a backing sheet on said plurality of envelopes to maintain it disposedly thereon.

7. An organizer wallet as recited in claim 3, wherein said identification means comprises a tab which is removable from an end portion of each page of said multi page pad.

8. An organizer wallet for identifying, holding and separately enclosing order checks, comprising:

a left hand cover having an inside and an outside face;

a right hand cover having an inside and an outside face;

a replacable multi page pad attached to one inside face; and a replacable plurality of envelopes for holding and enclosing a plurality of miniature menus or order checks;

removable indicating means on each page of said multi page pad; and enclosure means for displaying said indicating means one to an envelope after each of said indicating means has been removed from its respective page, to permit an orderly, neat and accessible means for maintaining order checks.

9. An organizer wallet as recited in claim 8, wherein each of said envelopes is of clear plastic material.

10. An organizer wallet as recited in claim 9 wherein each of said envelopes has a diagonally disposed pocket thereon, to hold order checks as they are being filled out.

11. An organizer wallet as recited in claim 10, wherein a diagonally disposed pocket is disposed onto one of said inside faces of one of said covers, to hold and maintain completed order checks.

12. An organizer wallet as recited in claim 10, wherein said enclosure means is made of clear plastic.

* * * * *